US008979556B2

(12) United States Patent
Chiu

(10) Patent No.: US 8,979,556 B2
(45) Date of Patent: Mar. 17, 2015

(54) COMMUNICATION SOCKET AND COMMUNICATION DEVICE

(71) Applicant: GT Contact Co., Ltd., New Taipei (TW)

(72) Inventor: Jui-Jung Chiu, Taoyuan County (TW)

(73) Assignee: GT Contact Co., Ltd., New Taipei (TW)

( * ) Notice: Subject to any disclaimer, the term of this patent is extended or adjusted under 35 U.S.C. 154(b) by 84 days.

(21) Appl. No.: 13/890,174

(22) Filed: May 8, 2013

(65) Prior Publication Data

US 2014/0335704 A1 Nov. 13, 2014

(51) Int. Cl.

| | |
|---|---|
| ***H01R 12/70*** | (2011.01) |
| ***H01R 24/64*** | (2011.01) |
| *H01R 13/66* | (2006.01) |
| *H01R 13/717* | (2006.01) |
| *H01R 107/00* | (2006.01) |

(52) U.S. Cl.

CPC ..... *H01R 12/7088* (2013.01); *H01R 13/6658* (2013.01); *H01R 13/7175* (2013.01); *H01R 24/64* (2013.01); *H01R 2107/00* (2013.01)

USPC ..... 439/78

(58) Field of Classification Search

USPC ..... 439/78, 79, 493, 374, 577, 362; 361/788

See application file for complete search history.

(56) References Cited

U.S. PATENT DOCUMENTS

| | | | | |
|---|---|---|---|---|
| 5,281,155 | A * | 1/1994 | Comerci et al. | 439/107 |
| 5,896,480 | A * | 4/1999 | Scharf et al. | 385/88 |
| 6,527,564 | B1 * | 3/2003 | Yeh | 439/76.1 |
| 7,128,582 | B2 * | 10/2006 | Fang et al. | 439/79 |
| 7,507,105 | B1 * | 3/2009 | Peters et al. | 439/374 |
| 7,549,894 | B1 * | 6/2009 | Wang | 439/577 |
| 7,592,719 | B2 * | 9/2009 | Hoopes | 307/155 |
| 7,848,115 | B2 * | 12/2010 | Casto et al. | 361/788 |
| 7,854,634 | B2 * | 12/2010 | Filipon et al. | 439/676 |
| 8,099,610 | B2 * | 1/2012 | Cousy | 713/300 |
| 8,512,071 | B2 * | 8/2013 | Tseng et al. | 439/493 |
| 8,758,044 | B2 * | 6/2014 | Tseng et al. | 439/493 |

* cited by examiner

*Primary Examiner* — Alexander Gilman

(74) *Attorney, Agent, or Firm* — Li & Cai Intellectual Property (USA) Office

(57) ABSTRACT

A communication socket comprises an outer casing, a circuit board, a communication connector, and a power terminal set. The outer casing has a power terminal passage formed penetratingly in the outer casing. The circuit board and the communication connector are arranged inside the outer casing. The communication connector is disposed between a side wall of the outer casing and the circuit board, and the communication connector electrically connects to the circuit board. The power terminal set is arranged in the power terminal passage and passed through the circuit board, wherein one end of the power terminal set exposes from the side wall of the outer casing, and another end of the power terminal set passes through the circuit board, and wherein the power terminal set and the circuit board are insulating to each other. The instant disclosure also provides a communication device.

6 Claims, 12 Drawing Sheets

COMMUNICATION SOCKET AND COMMUNICATION DEVICE

BACKGROUND OF THE INVENTION

1. Field of the Invention

The instant disclosure relates to a socket and a transmission device; more particular, to a communication socket and a communication device each capable of simultaneous transmission of signal and power.

2. Description of Related Art

Please refer to FIG. 1, which shows a conventional communication socket 100*a* that includes an outer casing 1*a* and a communication connector 2*a*. The outer casing 1*a* has a tubular shape. The outer casing 1*a* has an inserting opening 12*a* formed on a circular side wall 11*a* thereof. The communication connector 2*a* is installed in the outer casing 1*a* and exposed from the outer casing 1*a* via the inserting opening 12*a*, thereby allowing a communication plug (not shown) to be inserted into the conventional communication socket 100*a*.

However, the conventional communication socket 100*a* is designed only to transmit signal, and cannot be used to transmit/supply electrical power. When user needs to transmit signal and power at the same time, user must supplement the conventional communication socket 100*a* with a power transmission cable, so as to generate user's trouble and dangerous because of using power transmission cable.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a communication socket and a communication device each capable of simultaneous transmission of signal and power.

The communication socket comprises an outer casing having an inserting opening formed on an side wall thereof allowing access to an plug-receiving space defined therein; wherein the outer casing has a power terminal passage formed from the side wall to penetrate the outer casing, and an area of the power terminal passage arranged on the side wall is spaced from the inserting opening; a circuit board arranged in the plug-receiving space of the outer casing; a communication connector arranged in the plug-receiving space of the outer casing, wherein the communication connector is disposed between the side wall of the outer casing and the circuit board, and the communication connector electrically connects to the circuit board; and a power terminal set arranged in the power terminal passage and passed through the circuit board, wherein one end of the power terminal set exposes from the side wall of the outer casing, and another end of the power terminal set passes through the circuit board, and wherein the power terminal set and the circuit board are insulating to each other.

The communication device comprises a communication socket, comprising: an outer casing surroundingly defining an plug-receiving space and an inserting opening communicated with the plug-receiving space and formed on an side wall thereof; wherein the outer casing has a power terminal passage formed from the side wall to penetrate the outer casing, and an area of the power terminal passage arranged on the side wall is spaced from the inserting opening; a circuit board arranged in the plug-receiving space of the outer casing; a communication connector arranged in the plug-receiving space of the outer casing, wherein the communication connector is disposed between the side wall of the outer casing and the circuit board, and the communication connector electrically connects to the circuit board; and a power terminal set arranged in the power terminal passage and passed through the circuit board, wherein one end of the power terminal set exposes from the side wall of the outer casing, and another end of the power terminal set passes through the circuit board, and wherein the power terminal set and the circuit board are insulating to each other; and a communication plug for inserting into the communication socket along an insertable direction, the communication plug comprising: a housing has a mating power terminal passage penetratingly formed thereof; a mating communication connector installed on the housing; and a mating power terminal set arranged in the mating power terminal passage, wherein one end of the mating power terminal set exposes from the housing; wherein when the communication plug inserts into the communication socket, the mating communication connector engages with the communication connector via the inserting opening, and the mating power terminal set connects to the power terminal set.

Base on the above, the communication socket (or the communication device) further has a power transmission function without increasing the communication socket volume with respect to the related art, so as to be capable of simultaneous transmission of signal and power for preventing the dangerous from the wire entanglement. Moreover, the power terminal set passes through the circuit board with insulating to each other, so that the circuit board is used for positioning the power terminal set and preventing the signal transmission of the communication socket from power interference.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
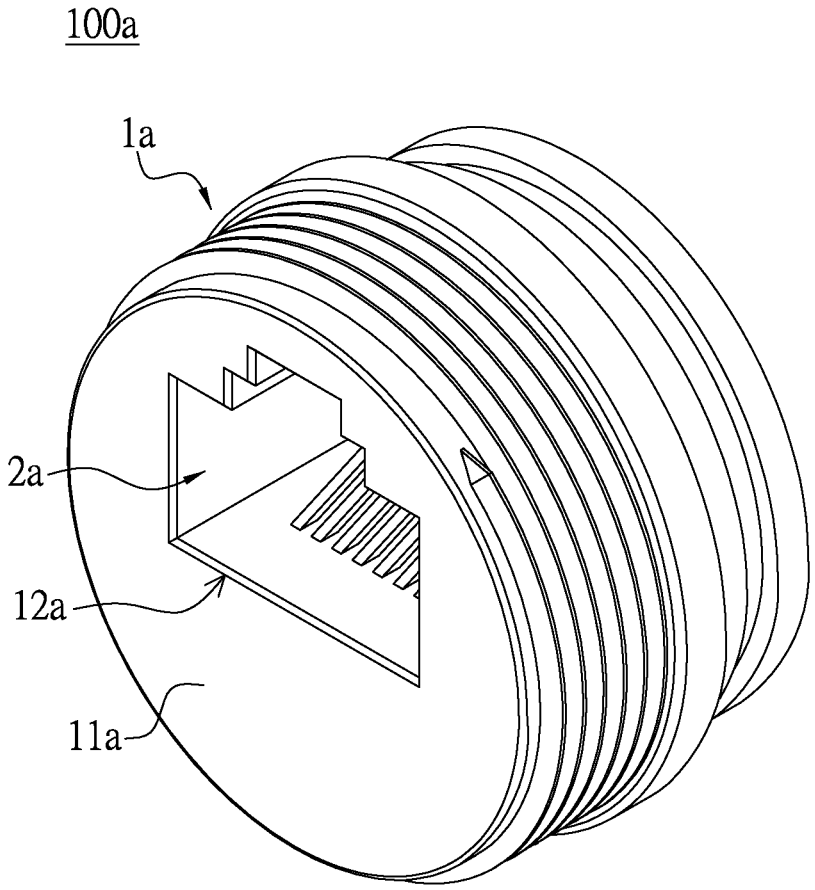
FIG.1 PRIOR ART
FIG. 1 is a perspective view showing a conventional communication socket.
Figure 2:
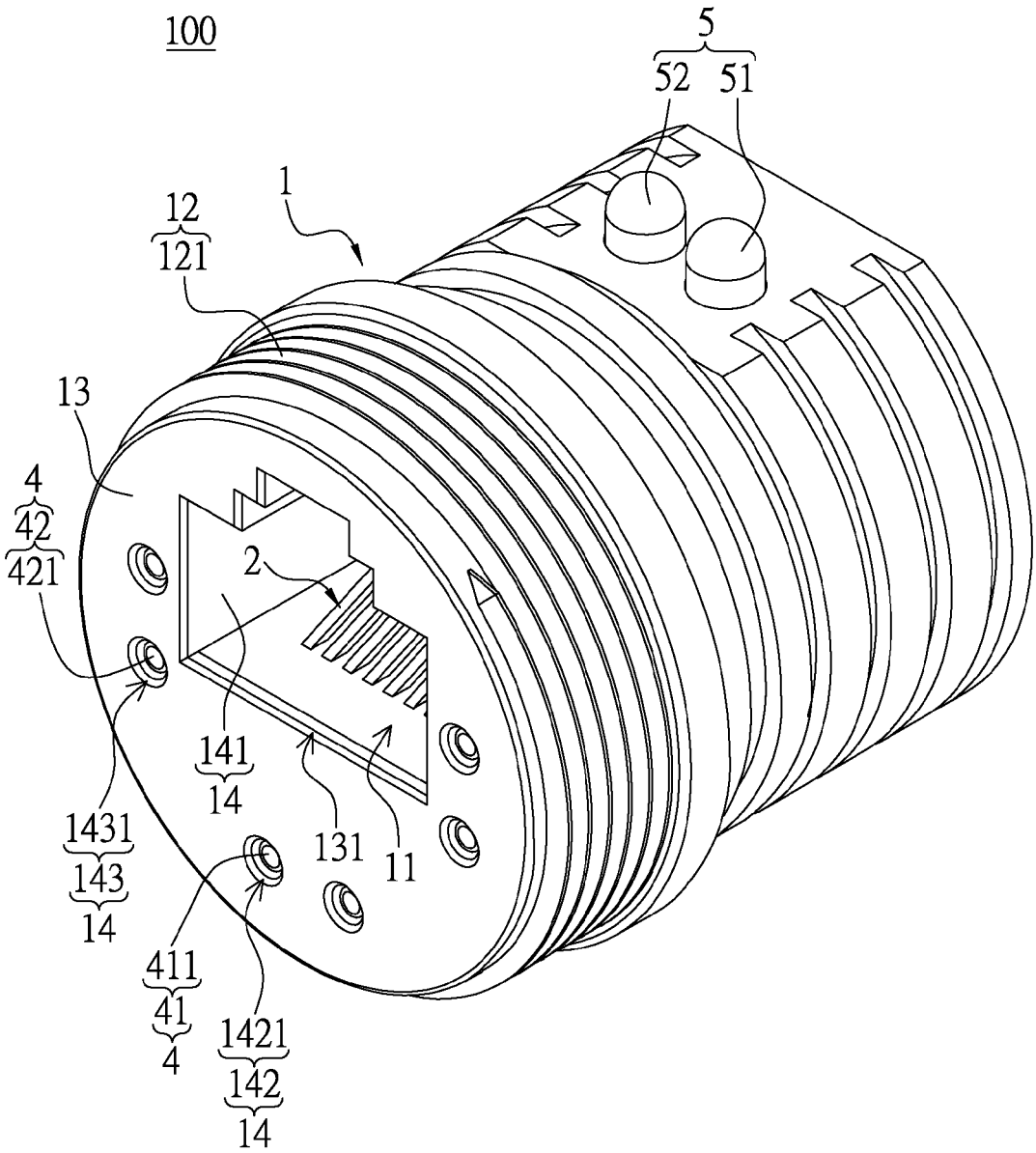
FIG. 2 is a perspective view showing a communication socket of the instant disclosure.

Please refer to FIG. 2, which shows an embodiment of the instant disclosure. This embodiment provides a communication socket 100 suitable for installing on manufacturing equipment (not shown) capable of simultaneously transmitting signal and power. The communication socket 100 is preferably a water-proof connector, but the type is not limited thereto. The communication socket 100 has an outer casing 1, a communication connector 2, a circuit board 3(as shown in FIG. 3), a terminal module 4, and an indicating module 5.

Figure 3:
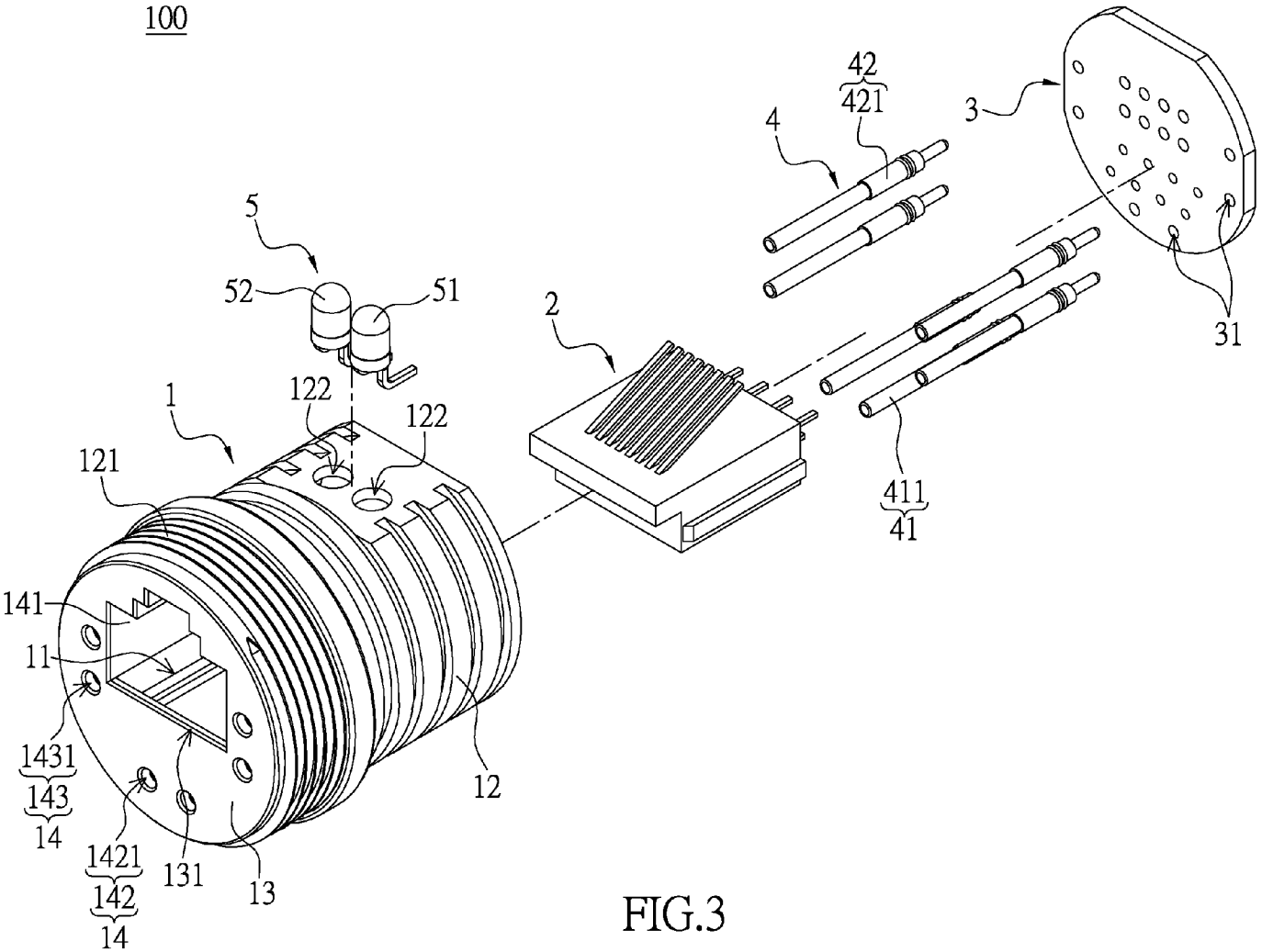
FIG. 3 is an explosive view showing the communication socket of the instant disclosure.
Figure 4:
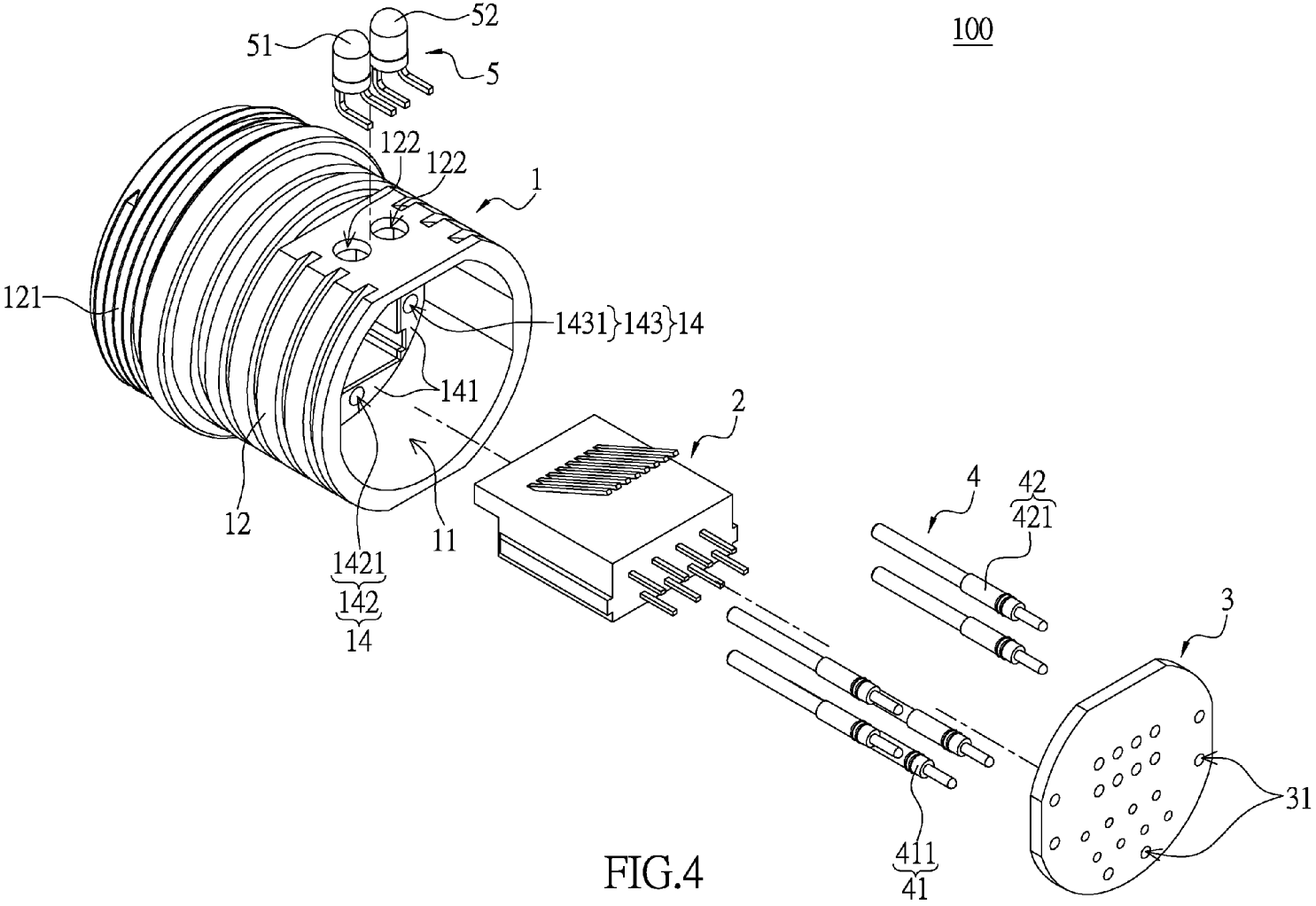
FIG. 4 is an explosive view with another viewing angle of FIG. 3.
Figure 5:
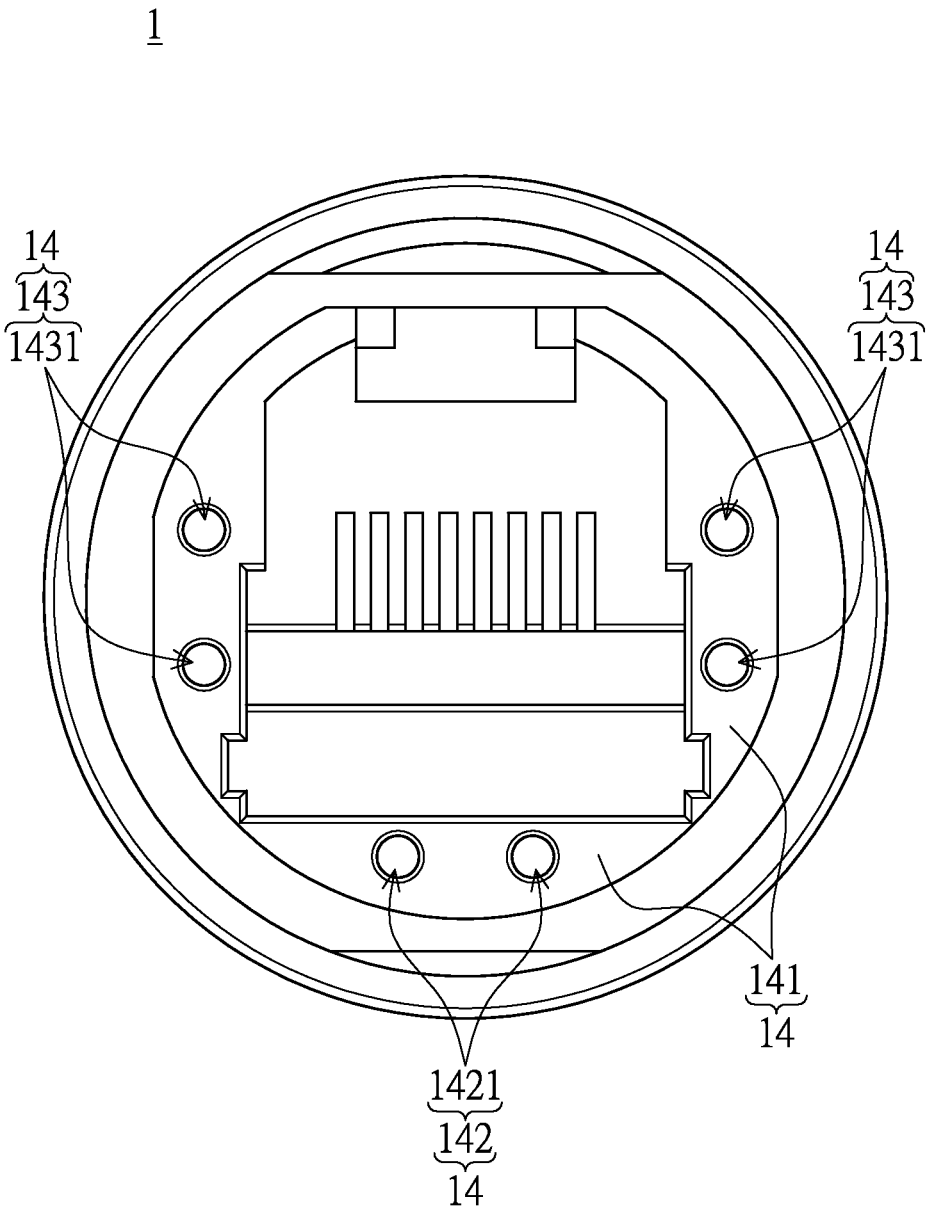
FIG. 5 is a planar view showing an outer casing of the communication socket of the instant disclosure.
Figure 6:
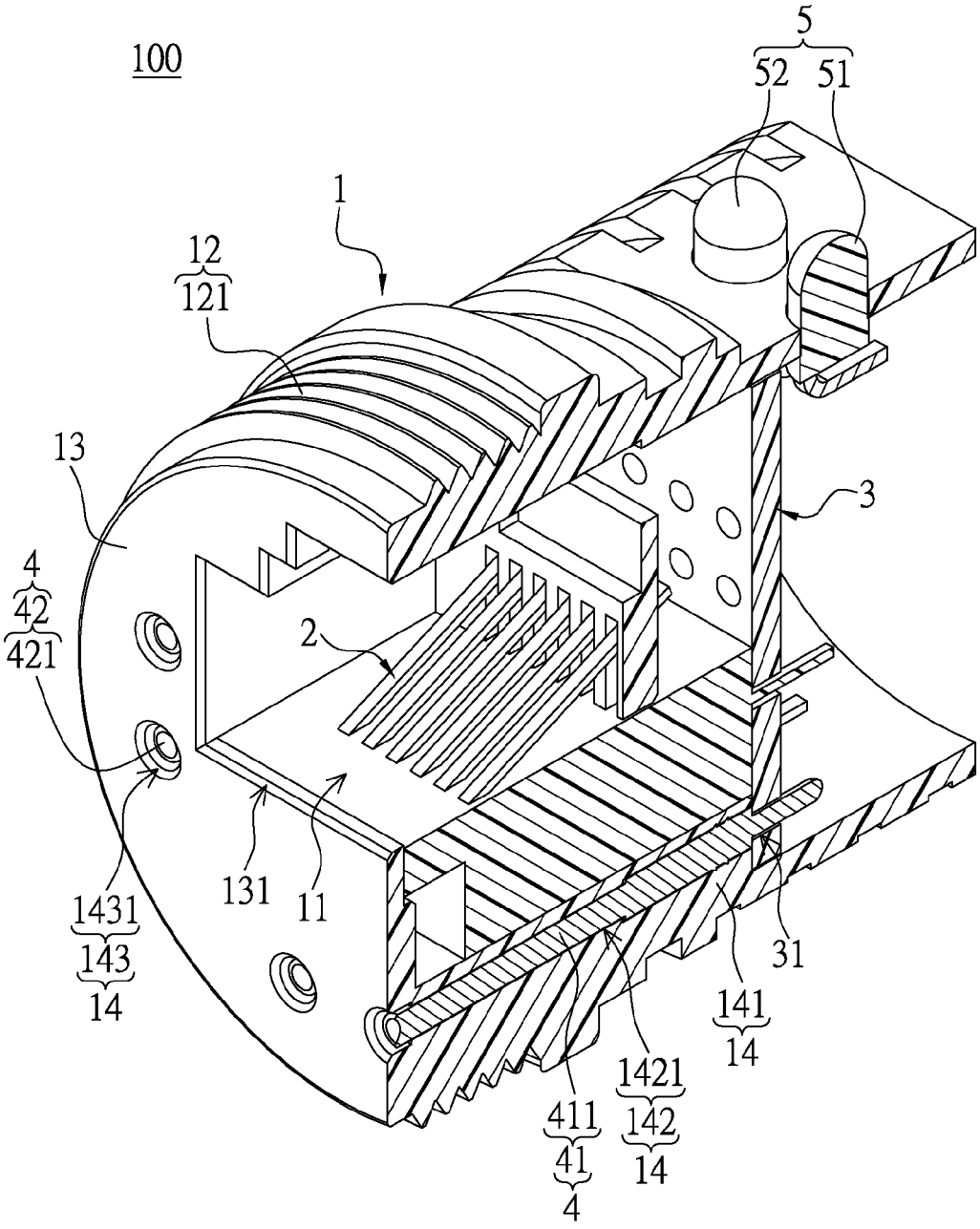
FIG. 6 is a cross-sectional view of the communication socket of the instant disclosure.
Figure 7:
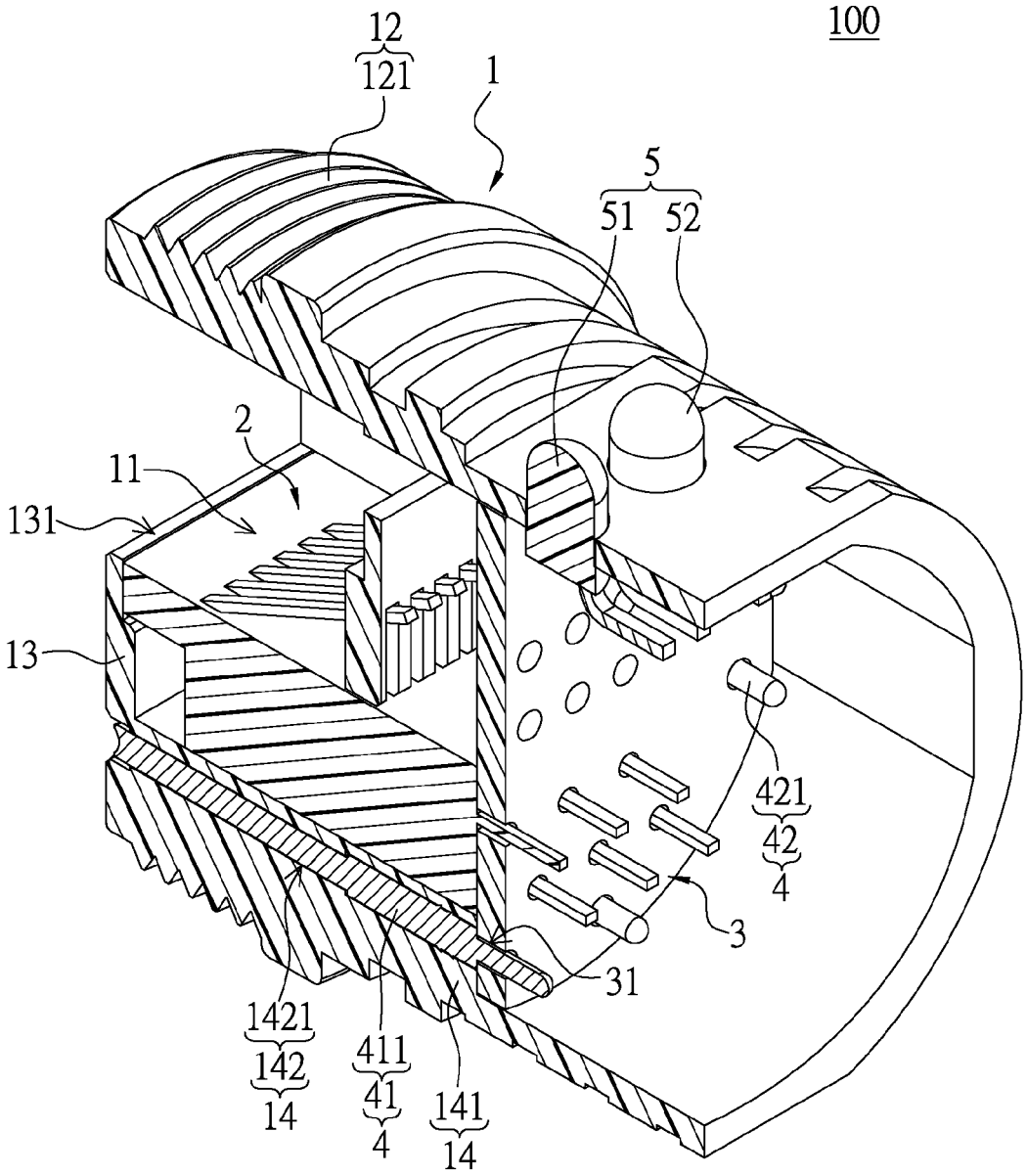
FIG. 7 is a cross-sectional view with another viewing angle of FIG. 6.
Figure 8:
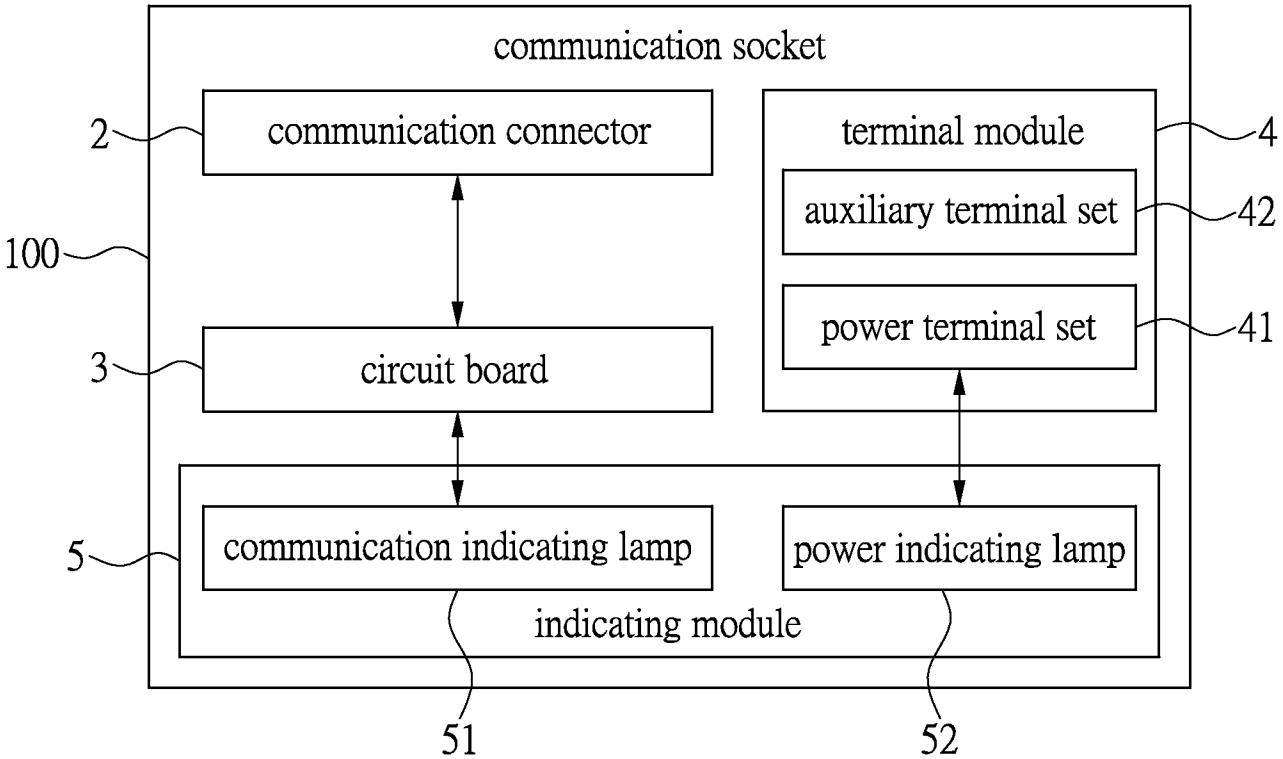
FIG. 8 is an electrical connection view of the communication socket of the instant disclosure.

Please refer to FIGS. 3 through 5, and with reference occasionally made to FIGS. 6 through 8 regarding the structural connection relationship of the communication socket's 100 various elements. The outer casing 1 surroundingly defines a plug-receiving space 11. The outer casing 1 has a tubular body 12 having a ring-shaped cross-section, a side wall 13 integrally formed on one end of the tubular body 12, and an inner wall 14 integrally extended from an inner surface of the tubular body 12 and the side wall 13. Particularly, the tubular body 12, the side wall 13, and the inner wall 14 are integrally formed as a one piece structure. The tubular body 12 has a thread 121 formed on an outer surface of a portion thereof adjacent to the side wall 13. The tubular body 12 has two penetrating holes 122 formed on an outer surface of another portion thereof away from the side wall 13. The side wall 13 has an inserting opening 131 communicated with the plug-receiving space 11. The outer casing 1 has a power terminal passage 142 formed from the side wall 13 to penetrate the inner wall 14 of the outer casing 1, and an area of the power terminal passage 142, arranged on the side wall 13, is spaced from the inserting opening 131. In other words, the area of the power terminal passage 142, arranged on the side wall 13, is arranged under the inserting opening 131 as shown in FIG. 6. The outer casing 11 has two auxiliary terminal passages 143 respectively formed from two opposite portions of the side wall 13, arranged on the left side and the right side of the inserting opening 131, as shown in FIG. 6, penetrating the inner wall 14.

Specifically, the inner wall 14 comprises three carrying segments 141, each having a substantially bow-shaped (circular segment) cross-section. The power terminal passage 142 is penetratingly formed in one of the carrying segments 141, arranged on the bottom of the inner wall 14 as shown in FIG. 5, and the auxiliary terminal passages 143 are respectively penetratingly formed in the other carrying segments 141. In this embodiment, the power terminal passage 142 and the auxiliary terminal passages 143 each one takes two cylindrical sub channels 1421, 1431 for example, and each sub channel 1421 of the power terminal passage 142 and each sub channel 1431 of each auxiliary terminal passage 143 are parallel to each other, but not limited to this embodiment.

Figure 9:
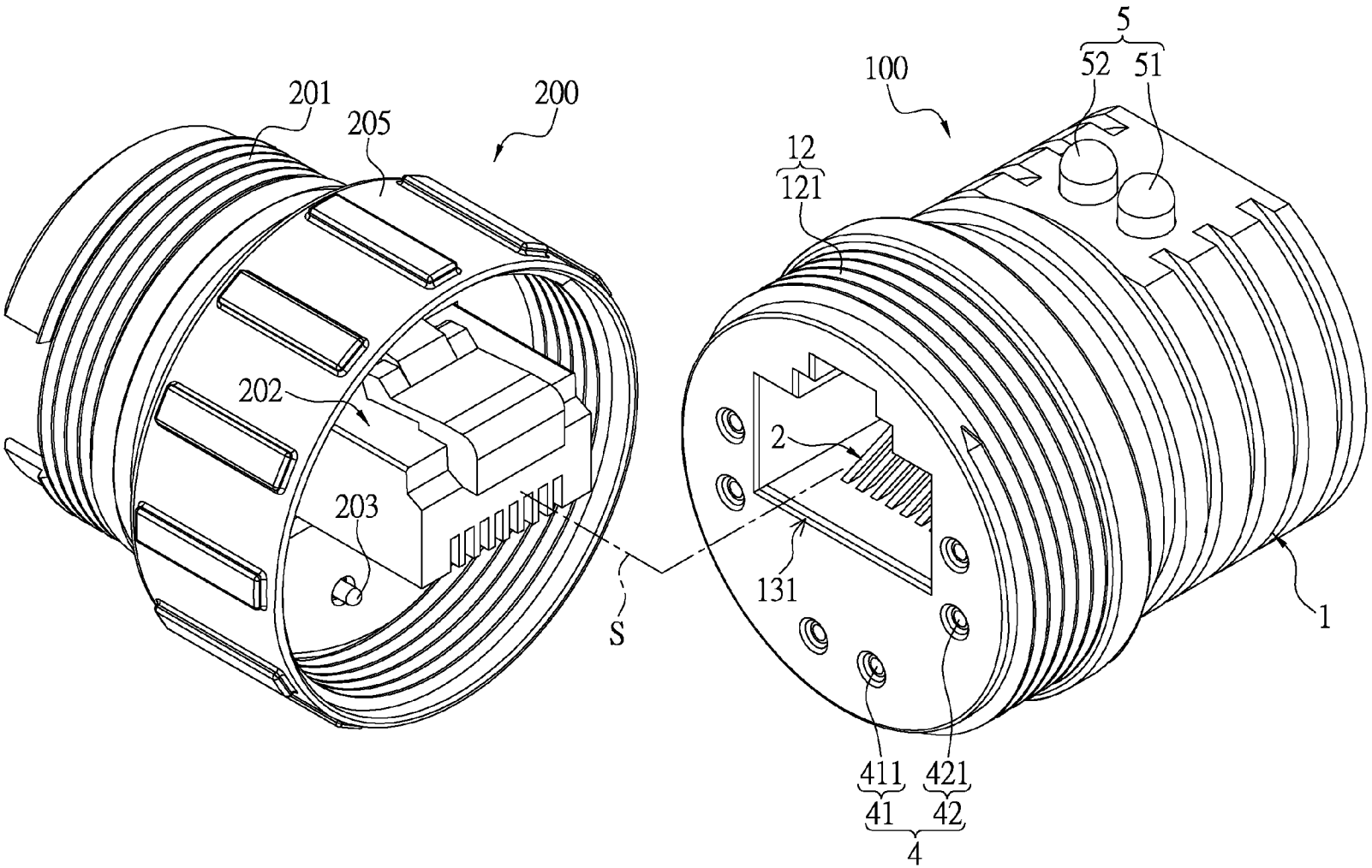
FIG. 9 is an explosive view showing a communication device of the instant disclosure.
Figure 10:
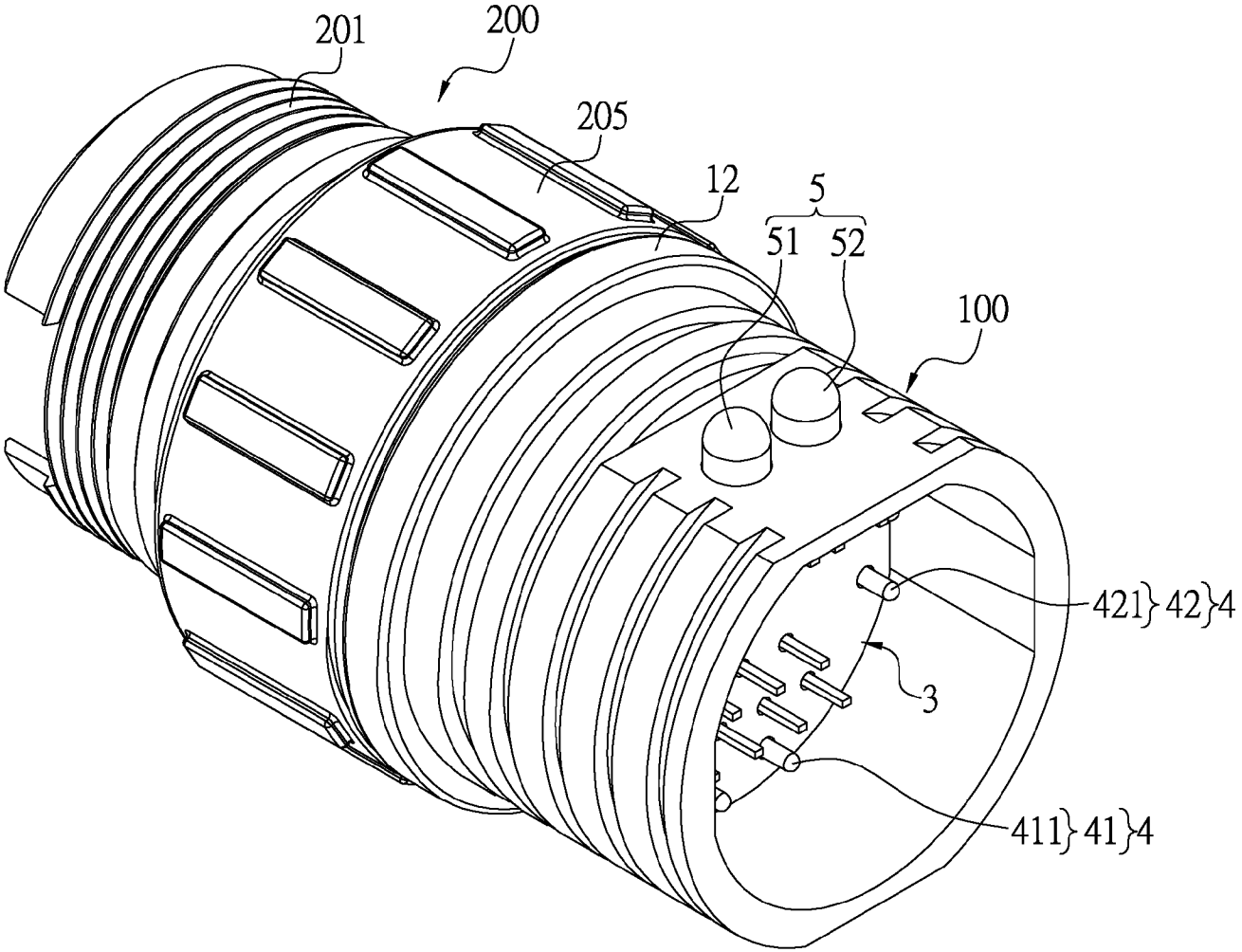
FIG. 10 is a perspective view showing the communication device of the instant disclosure.
Figure 11:
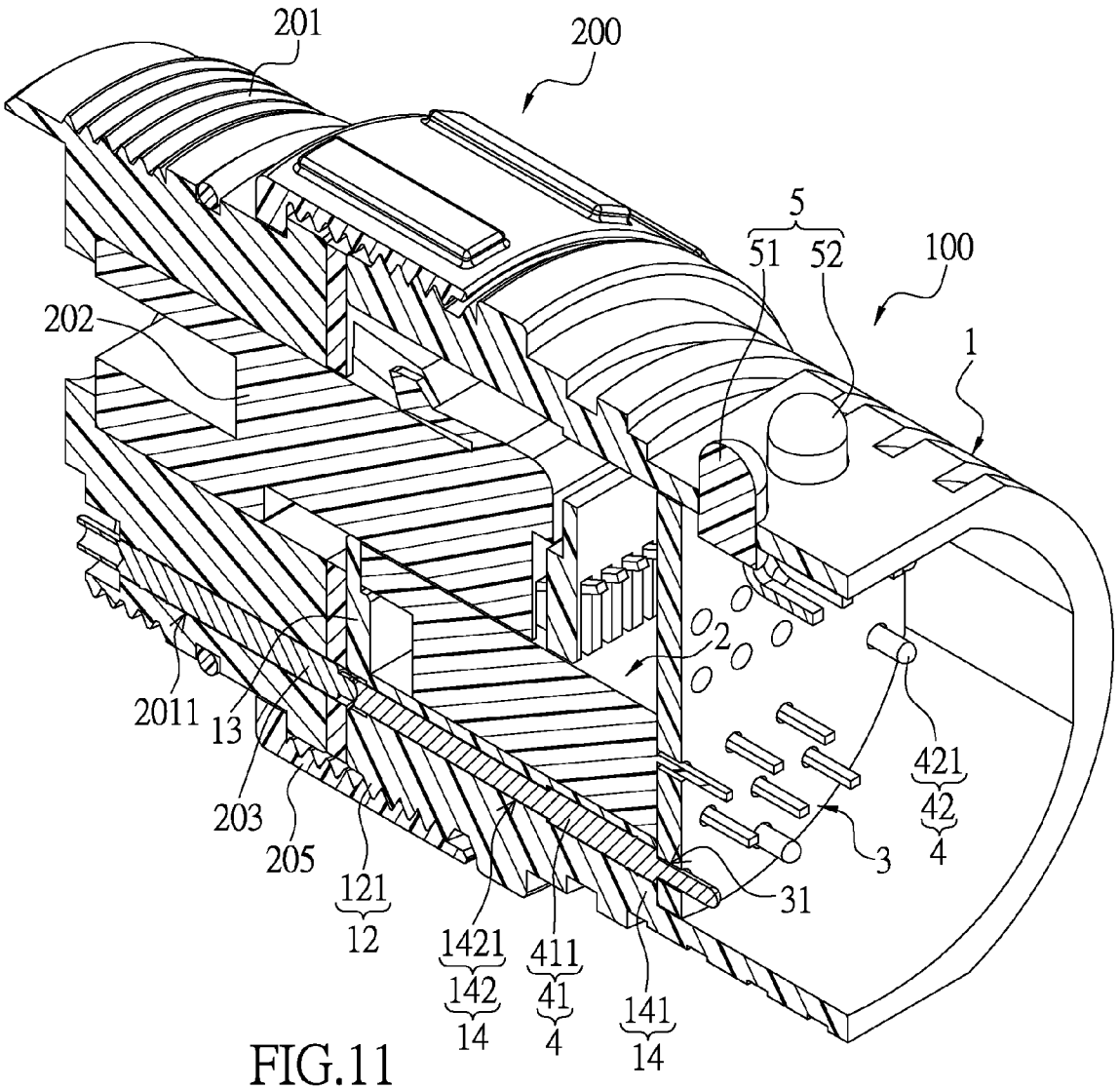
FIG. 11 is a cross-sectional view of the communication device of the instant disclosure.
Figure 12:
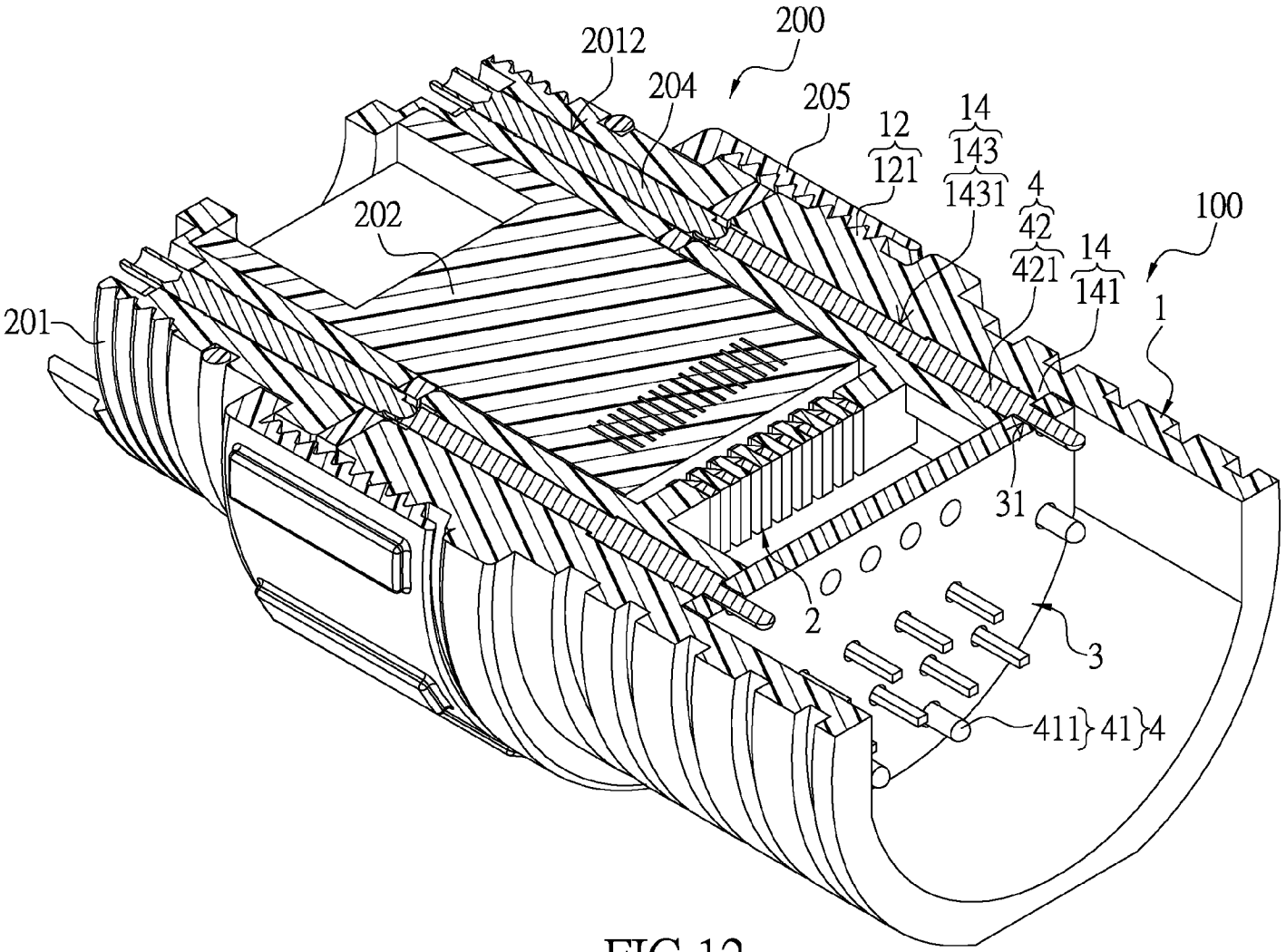
FIG. 12 is a cross-sectional view with another viewing angle of FIG. 11.

The communication connector 2 (e.g., RJ 45 socket connector) is arranged in the plug-receiving space 11 of the outer casing 1. In more detail, the communication connector 2 is substantially arranged in a space defined by the inner wall 14. The communication connector 2 is exposed from the inserting opening 131, so that the communication connector 2 is configured to provide inserting of a mating communication connector 202 (as shown in FIG. 9) via the inserting opening 131.

The circuit board 3 is a substantially circular plate, and the contour of the circuit board 3 is approximately identical to the cross-section of the tubular body 12 of the outer casing 1. The circuit board 3 is arranged in the plug-receiving space 11 of the outer casing 1, and the plane of the circuit board 3 substantially abuts on a surface of the inner wall 4, away from the side wall 13, for clipping the communication connector 2 between the side wall 13 and the circuit board 3. The communication connector 2 is electrically connected to the circuit board 3 by a welding manner. Moreover, the circuit board 3 has a plurality of the thru holes 31, and the thru holes 31 are respectively align the sub channels 1421, 1431, so that the sub channels 1421, 1431 and the corresponding thru holes 31 are communicated with each other.

The terminal module 4 has a power terminal set 41 and two auxiliary terminal sets 42. In this embodiment, the power terminal set 41 has two power terminals 411, each auxiliary terminal set 42 has two auxiliary terminals 421, but in practice, the terminal number of the power terminal set 41 or the auxiliary terminal set 42 is not limited to this embodiment. Incidentally, the auxiliary terminal set 42 can be the signal transmitting type or the power transmitting type.

The power terminals 411 of the power terminal set 41 are respectively arranged in the sub channels 1421 of the power terminal passage 142, and the power terminals 411 respectively pass through the corresponding thru holes 31 of the circuit board 3. Each power terminal 411 is perpendicular to the plane of the circuit board 3. Specifically, one end of each power terminal 411 of the power terminal set 41 exposes from the side wall 13 of the outer casing 1, and another end of each power terminal 411 of the power terminal set 41 passes through the circuit board 3. Each power terminal 411 of the power terminal set 41 and the circuit board 3 are insulating to each other for preventing the signal transmission of the communication socket 100 from power interference.

The auxiliary terminals 421 of each auxiliary terminal set 42 are respectively arranged in the sub channels 1431 of each auxiliary terminal passage 143, and each auxiliary terminal 421 passes through each corresponding thru hole 31 of the circuit board 3. Each auxiliary terminal 421 is perpendicular to the plane of the circuit board 3. Specifically, one end of each auxiliary terminal 421 exposes from the side wall 13 of the outer casing 1, and another end of each auxiliary terminal 411 passes through the circuit board 3. Each auxiliary terminal 421 and the circuit board 3 are insulating to each other for preventing the signal transmission of the communication socket 100 from interference.

The indicating module 5 has a communication indicating lamp 51 and a power indicating lamp 52. The communication indicating lamp 51 and the power indicating lamp 52 respectively pass through the penetrating holes 122 of the tubular body 12 for installing the communication indicating lamp 51 and the power indicating lamp 52 on the outer casing 1 and exposing partial of the communication indicating lamp 51 and partial of the power indicating lamp 52.

The communication indicating lamp 51 is electrically connected to the communication connector 2. Moreover, the communication indicating lamp 51 can be directly connected to the communication connector 2, or the communication indicating lamp 51 can be connected to the circuit board 3 directly or via a transmission wire for indirectly connecting to the communication connector 2. The power indicating lamp 52 is electrically connected to the power terminal set 41. The power indicating lamp 52 can be connected to the power terminal set 41 directly or via a transmission wire.

Please refer to FIGS. 9 through 12, which show a communication device of the instant disclosure. The communication device includes a communication plug 200 and the communication socket 100. The communication plug 200 is a corresponding construction for inserting into the communication socket 100 along an insertable direction S. The type of the communication plug 200 is preferable a water-proof connector, but the type is not limited thereto. The following description states the possible structure of the communication plug 200, but the structure is not limited to this embodiment.

The communication plug 200 has a housing 201, a mating communication connector 202, a mating power terminal set 203, two auxiliary terminal sets 204, and a nut 205. The housing 201 has a mating power terminal passage 2011 and two mating auxiliary terminal passages 2012, which are respectively parallelly penetrating formed thereof. The mating power terminal passage 2011 and the mating auxiliary terminal passages 2012 each one takes two cylindrical sub channels for example, and each sub channel of the mating power terminal passage 2011 and each sub channel of each mating auxiliary terminal passage 2012 are parallel to each other, but not limited to this embodiment. The nut 205 is movably installed on an outer surface of the housing 201 along the insertable direction S.

The mating communication connector 202 (e.g., RJ 45 plug connector) is installed on the housing 201, and partial of the mating communication connector 202 is exposed from the housing 201. The mating power terminal passage 2011 and the mating auxiliary terminal passages 2012 are arranged around the mating communication connector 202.

The mating power terminal set 203 has two terminals, and each mating auxiliary terminal set 204 has two terminals. That is to say, the terminal number of the mating power terminal set 203 is identical to the terminal number of the power terminal set 41, and the terminal number of each mating auxiliary terminal set 204 is identical to the terminal number of each auxiliary terminal set 42. But in practice, the terminal number of the mating power terminal set 203 or each mating auxiliary terminal set 204 is not limited to this embodiment. Specifically, the terminals of the mating power terminal set 203 are respectively arranged in the sub channels of the mating power terminal passage 2011, and one end of each terminal of the mating power terminal set 203 exposes from the housing 201. The terminals of each mating auxiliary terminal set 204 are respectively arranged in the sub channels of each mating auxiliary terminal passage 2012, and one end of each terminal of each mating auxiliary terminal set 204 exposes from the housing 201.

Incidentally, the positions of the mating communication connector 202, the mating power terminal set 203, and the mating auxiliary terminal sets 204 are respectively corresponding to the positions of the communication connector 2, the power terminal set 41, and the mating auxiliary terminal sets 42. Moreover, in this embodiment, the mating power terminal set 203, the mating auxiliary terminal sets 204, the power terminal set 41, and the auxiliary terminal sets 42 are substantially parallel to the insertable direction S.

When the communication plug 200 inserts into the communication socket 100, the mating communication connector 202 passes through the inserting opening 131 to couple to the communication connector 2, and the mating power terminal set 203 connects to the power terminal set 41, thereby achieving simultaneous transmission of signal and power. And then, the nut 205 of the communication plug 200 screws on the thread 121 of the tubular body 12 of the communication socket 100 to firmly combine the communication socket 100 and the communication plug 200. Moreover, each mating auxiliary terminal set 204 connects to each auxiliary terminal set 42 to transmit power or another kind signal, which different from the signal transmitting between the mating communication connector 202 and the communication connector 2.

When the signal transmission between the communication plug 200 and the communication socket 100 is normal, the communication indicating lamp 51 lights, but when the signal transmission between the communication plug 200 and the communication socket 100 is abnormal (e.g., interruption of the signal transmission), the communication indicating lamp 51 does not light. Thus, the user can get the signal transmission state immediately by the communication indicating lamp 51.

Moreover, when the power transmission between the communication plug 200 and the communication socket 100 is normal, the power indicating lamp 52 lights, but when the power transmission between the communication plug 200 and the communication socket 100 is abnormal (e.g., interruption of the power transmission), the power indicating lamp 52 does not light. Thus, the user can get the power transmission state immediately by the power indicating lamp 52.

Base on the above, the communication socket (or the communication device) further has a power transmission function without increasing the communication socket volume with respect to the related art, so as to be capable of simultaneous transmission of signal and power for preventing the dangerous from the wire entanglement.

Moreover, the communication socket has the terminal module by installing on the bow-shaped carrying segments, and the terminal module passes through the circuit board with insulating to each other, so that the circuit board is used for positioning the terminal module and preventing the signal transmission of the communication socket from power interference.

Additionally, the structure of the mating power terminal set and the mating auxiliary terminal sets of the communication plug is similar to the structure of the power terminal set and the auxiliary terminal sets of the communication socket, so that the communication plug further has a power transmission function.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A communication socket, comprising:

an outer casing having an inserting opening formed on an side wall thereof allowing access to an plug-receiving space defined therein; wherein the outer casing has a power terminal passage formed from the side wall to penetrate the outer casing, and an area of the power terminal passage arranged on the side wall is spaced from the inserting opening, wherein the outer casing has an inner wall formed on an inner side thereof, the power terminal passage is penetratingly formed in the inner wall, the communication connector is arranged in a space surroundingly defined by the inner wall, wherein the outer casing has a tubular body having a ring-shaped cross-section, the side wall is integrally formed on one end of the tubular body, the inner wall is formed on an inner surface of the tubular body, and wherein the inner wall has three carrying segments each having a substantially bow-shaped cross-section, the power terminal passage is penetratingly formed in one of the carrying segments;

a circuit board arranged in the plug-receiving space of the outer casing, wherein the circuit board contacts a surface of the inner wall away from the side wall;

a communication connector arranged in the plug-receiving space of the outer casing, wherein the communication connector is disposed between the side wall of the outer casing and the circuit board, and the communication connector electrically connects to the circuit board; and a power terminal set arranged in the power terminal passage and passed through the circuit board, wherein one end of the power terminal set exposes from the side wall of the outer casing, and another end of the power terminal set passes through the circuit board, and wherein the power terminal set and the circuit board are insulating to each other.

2. The communication socket as claimed in claim 1, wherein the power terminal set is substantially perpendicular to a plane of the circuit board.

3. The communication socket as claimed in claim 1, wherein the outer casing has at least one auxiliary terminal passage penetratingly formed in at least one of the other carrying segments without forming the power terminal passage, the communication socket has at least one auxiliary terminal set arranged in the auxiliary terminal passage and passed through the circuit board, wherein one end of the auxiliary terminal set exposes from the side wall of the outer casing, and another end of the auxiliary terminal set passes through the circuit board, and wherein the auxiliary terminal set and the circuit board are insulating to each other.

4. The communication socket as claimed in claim 1, further comprising a power indicating lamp, wherein the power indicating lamp is installed on the outer casing and electrically connected to the power terminal set, and at least partial the power indicating lamp exposes from the outer casing.

5. The communication socket as claimed in claim 1, further comprising a communication indicating lamp, wherein the communication indicating lamp is installed on the outer casing and electrically connected to the communication connector, and at least partial the communication indicating lamp exposes from the outer casing.

6. A communication device, comprising:

a communication socket, comprising:

an outer casing having an inserting opening formed on an side wall thereof allowing access to an plug-receiving space defined therein; wherein the outer casing has a power terminal passage formed from the side wall to penetrate the outer casing, and an area of the power terminal passage arranged on the side wall is spaced from the inserting opening, wherein the outer casing has an inner wall formed on an inner side thereof, the power terminal passage is penetratingly formed in the inner wall, the communication connector is arranged in a space surroundingly defined by the inner wall, wherein the outer casing has a tubular body having a ring-shaped cross-section, the side wall is integrally formed on one end of the tubular body, the inner wall is formed on an inner surface of the tubular body, and wherein the inner wall has three carrying segments each having a substantially bow-shaped cross-section, the power terminal passage is penetratingly formed in one of the carrying segments;

a circuit board arranged in the plug-receiving space of the outer casing, wherein the circuit board contacts a surface of the inner wall away from the side wall;

a communication connector arranged in the plug-receiving space of the outer casing, wherein the communication connector is disposed between the side wall of the outer casing and the circuit board, and the communication connector electrically connects to the circuit board; and a power terminal set arranged in the power terminal passage and passed through the circuit board, wherein one end of the power terminal set exposes from the side wall of the outer casing, and another end of the power terminal set passes through the circuit board, and wherein the power terminal set and the circuit board are insulating to each other; and a communication plug for inserting into the communication socket along an insertable direction, the communication plug comprising:

a housing has a mating power terminal passage penetratingly formed thereof;

a mating communication connector installed on the housing; and a mating power terminal set arranged in the mating power terminal passage, wherein one end of the mating power terminal set exposes from the housing;

wherein when the communication plug inserts into the communication socket, the mating communication connector engages with the communication connector via the inserting opening, and the mating power terminal set connects to the power terminal set.

* * * * *